US011006677B2

(12) United States Patent
Jones

(10) Patent No.: US 11,006,677 B2
(45) Date of Patent: May 18, 2021

(54) MAGNETIC POCKET SQUARE

(71) Applicant: Randolph Winston Jones, Inglewood, CA (US)

(72) Inventor: Randolph Winston Jones, Inglewood, CA (US)

( * ) Notice: Subject to any disclaimer, the term of this patent is extended or adjusted under 35 U.S.C. 154(b) by 76 days.

(21) Appl. No.: 16/256,227

(22) Filed: Jan. 24, 2019

(65) Prior Publication Data

US 2019/0289925 A1 Sep. 26, 2019

Related U.S. Application Data

(60) Provisional application No. 62/645,620, filed on Mar. 20, 2018.

(51) Int. Cl.
*A41B 15/02* (2006.01)
*A41D 27/20* (2006.01)

(52) U.S. Cl.
CPC ..... *A41B 15/02* (2013.01); *A41D 27/20* (2013.01)

(58) Field of Classification Search
CPC ..... A41B 15/00; A41B 15/02; A41D 27/20
See application file for complete search history.

(56) References Cited

U.S. PATENT DOCUMENTS 1,466,993 A * 9/1923 Creech, Jr. ..... A41B 15/02 2/279
1,650,030 A * 11/1927 Myers ..... A41B 15/02 2/279
2,060,729 A * 11/1936 Gilgenbach ..... A41B 15/02 2/279
4,388,734 A * 6/1983 Cowden ..... A45C 13/185 2/250
5,231,702 A * 8/1993 Masters ..... A41B 15/02 2/244
7,854,021 B2 * 12/2010 Compton ..... G09F 21/02 2/243.1
9,516,903 B1 * 12/2016 Gambuzza ..... A41B 15/02
2005/0144704 A1 * 7/2005 Vitallo ..... A41B 1/00 2/247
2006/0015987 A1 * 1/2006 Anderson ..... A41D 27/20 2/247
2008/0066212 A1 * 3/2008 Holden ..... A45C 1/04 2/69

(Continued)

*Primary Examiner* — Shaun R Hurley
*Assistant Examiner* — Bao-Thieu L Nguyen
(74) *Attorney, Agent, or Firm* — Ansari Katiraei LLP; Arman Katiraei; Sadiq Ansari

(57) ABSTRACT

Provided is a single-piece magnetic pocket square that folds over a pocket, and that uses magnets to retain its position and shape about the pocket. The pocket square provides adornment or an accessory that adds visual flair to the pocket in the same manner as a handkerchief or traditional pocket square while retaining its shape and position. The pocket square includes an inner rigid material extending between an upper half and a lower half, a bend plane at which the upper half folds towards the lower half, magnets attached to the upper half and lower half of the inner rigid material, and a fabric covering the pocket square. The pocket square works by placing the lower half in the pocket, and by folding the upper half over the pocket to create a magnetic force that couples the upper half to the lower half with the pocket edge disposed in between.

10 Claims, 8 Drawing Sheets

(56) References Cited

U.S. PATENT DOCUMENTS

| | | | | |
|---|---|---|---|---|
| 2009/0049719 | A1* | 2/2009 | Compton | G09F 21/02 40/586 |
| 2009/0178173 | A1* | 7/2009 | Schultz | A41D 19/01 2/16 |
| 2011/0056001 | A1* | 3/2011 | Missett | A41D 27/201 2/244 |
| 2011/0307420 | A1* | 12/2011 | Shaw | G06Q 99/00 705/500 |
| 2015/0059062 | A1* | 3/2015 | McClellan | A41B 15/02 2/279 |
| 2016/0015086 | A1* | 1/2016 | Kinnebrew | A44B 99/00 24/303 |
| 2016/0120234 | A1* | 5/2016 | Cobb | A41B 15/02 2/250 |
| 2018/0332903 | A1* | 11/2018 | Payne | A45F 5/022 |
| 2019/0098939 | A1* | 4/2019 | Pena | A41B 15/02 |
| 2019/0208833 | A1* | 7/2019 | Fleming | A41B 15/02 |

* cited by examiner

MAGNETIC POCKET SQUARE

CLAIM OF BENEFIT TO RELATED APPLICATIONS

This application claims the benefit of U.S. provisional application 62/645,620, entitled "Magnetic Pocket Square (PSquare)", filed Mar. 20, 2018. The contents of application 62/645,620 are hereby incorporated by reference.

FIELD OF THE INVENTION

The invention relates to clothing, apparel, and apparel accessories.

BACKGROUND ART

Business suits, sport coats, dress shirts and other clothing with a breast pocket may be adorned with handkerchiefs and/or other fabric to accessorize and/or provide the breast pocket with visual flair. However, handkerchiefs and/or other fabric may easily lose their form after being inserted in the breast pocket. The loss of form may occur from regular movements and because of the loose nature of the material and how it is simply inserted in the breast pocket. With improper insertion and/or sufficient movement, the handkerchief may not only lose its visual flair, but may also create an undesirable bulge in the breast pocket.

DETAILED DESCRIPTION

The following detailed description refers to the accompanying drawings. The same reference numbers in different drawings may identify the same or similar elements.

The disclosed embodiments provide a single-piece magnetic pocket square, hereinafter referred to as the "PSquare". The PSquare is a clothing product or clothing accessory that can connect directly over a pocket, lapel, or other clothing edge by folding over the pocket, lapel, or other clothing edge and by using integrated magnets to retain the position and shape of the PSquare about the pocket, lapel, or other clothing edge. The side of the PSquare that folds over the exterior face of the pocket, lapel, or other clothing edge provides adornment or an accessory that adds visual flair to the pocket, lapel, or clothing edge in the same manner as a handkerchief or traditional pocket square.

The PSquare can replace traditional handkerchiefs, loose fabrics, and traditional non-magnetized pocket squares, while providing added peace-of-mind to the user that the PSquare will not lose its shape or position about adorned garment. The PSquare is a single piece that is more convenient to carry and use than other attachments that use a first piece magnetic base to hold a separate and detached second piece handkerchief or other fabric. There is therefore no need to carry two separate items to adorn clothing with visual flair.

Figure 1:
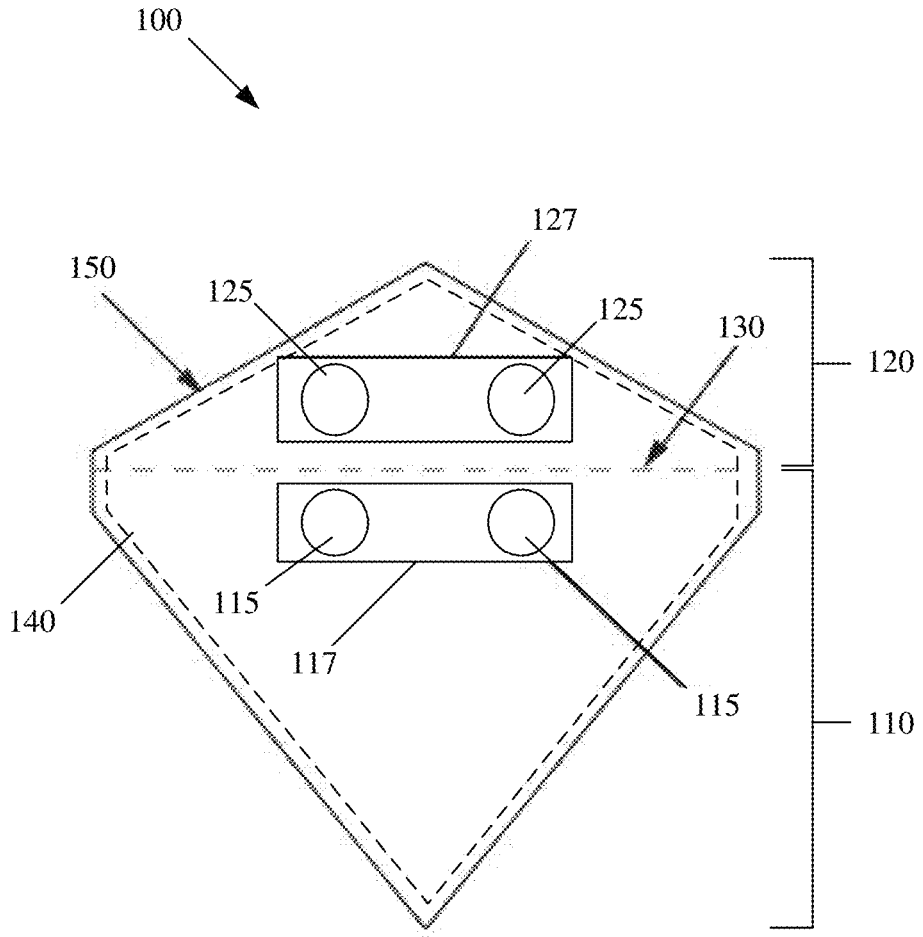
FIG. 1 illustrates a back view of an example PSquare in accordance with some embodiments.

FIG. 1 illustrates a back view of example PSquare 100 in accordance with some embodiments. As shown, PSquare 100 is a single piece comprised of a lower half 110 with one or more integrated magnets 115 of a first polarity, and an upper half 120 with one or more integrated magnets 125 of an opposite second polarity. In some embodiments, magnets 115 and 125 may be replaced with magnetic plates 117 and 127 having opposite polarities. PSquare 100 may further include bend plane 130 where upper half 120 may be folded over lower half 110 such that magnets 115 and 125, because of their opposite polarity, become aligned and couple upper half 120 to lower half 110 with magnetic force.

Lower half 110 may include inner rigid material 140 onto which magnets 115 are set. Inner rigid material 140 may be a cardboard, piece of plastic, metal, or other rigid element that does not easily lose form. Inner rigid material 140 may have a triangular shape that narrows to a point at the distal end from bend plane 130. The triangular shape allows lower half 110 to be inserted into pockets of different sizes and/or widths. In some other embodiments, lower half 110 may have another shape. For instance, lower half 110 may have different rectangular, square, or semi-circular shapes with different widths or radii to fit in pockets of different widths. In some embodiments, magnets 115 may be attached to inner rigid material 140 with an adhesive (e.g., tape, glue, etc.).

Inner rigid material 140 may also extend into upper half 120. For instance, inner rigid material 140 may be a single piece of cardboard or other rigid material in the form of PSquare 100, and may include a bend at bend plane 130.

In some other embodiments, upper half 120 may have a first rigid backing material that is separate from a second rigid backing material of lower half 110. The first rigid backing material may be aligned with the second rigid back material at bend plane 130.

In either case, upper half 120 has magnets 125 adhered or otherwise affixed to inner rigid material 140 of upper half 120. Magnets 115 of lower half 110 and magnets 125 of upper half 120 are about equidistant from bend plane 130. For instance, magnets 115 may be a first distance below bend plane 130, and separated from each other by a second distance (e.g., when lower half 110 includes two or more magnets 115). Magnets 125 may be the first distance above bend plane 130, and separated from each other by the second distance (e.g., when upper half 120 includes two or more magnets 125).

Although upper half 120 is shown to have a similar shape and form as lower half 110 in FIG. 1, upper half 120 may have a different shape or form than lower half 110 in some other embodiments. The shape or form of upper half 120 does not alter the usage of PSquare 100, although the upper half 120 shape or form defines the visual flair that PSquare 100 adds to a garment when coupled thereto. In some embodiments, upper half 110 may have different rectangular, square, or semi-circular shapes with different widths or radii that fold over a pocket, lapel, or other clothing edge. In some embodiments, magnets 125 may be attached to inner rigid material 140 with an adhesive.

Fabric 150 covers inner rigid material 140, magnets 115 of lower half 110, and magnets 125 of upper half 120. In other words, fabric 150 would hide magnets 115 and 125 from view, although magnets 115 and 125 might produce slight bumps across fabric 150.

In some embodiments, fabric 150 may include two fabric segments with a first segment covering a frontside of PSquare 100 and a second segment covering a backside of PSquare 100. The first and second segments may be adhered, stitched, or otherwise bonded together.

In some embodiments, fabric 150 is a single piece of fabric with an opening into which the internal components of PSquare 100 are inserted. The opening may then be closed to prevent the internal components from moving.

In either case, PSquare 100 is a single piece or item that provides visual flair while retaining its shape and placement on a pocket, lapel, or clothing edge. Different PSquares 100 may have different fabric 150 coverings to provide different ornamental designs or visual flair over at least the front side of PSquare 100.

Figure 2:
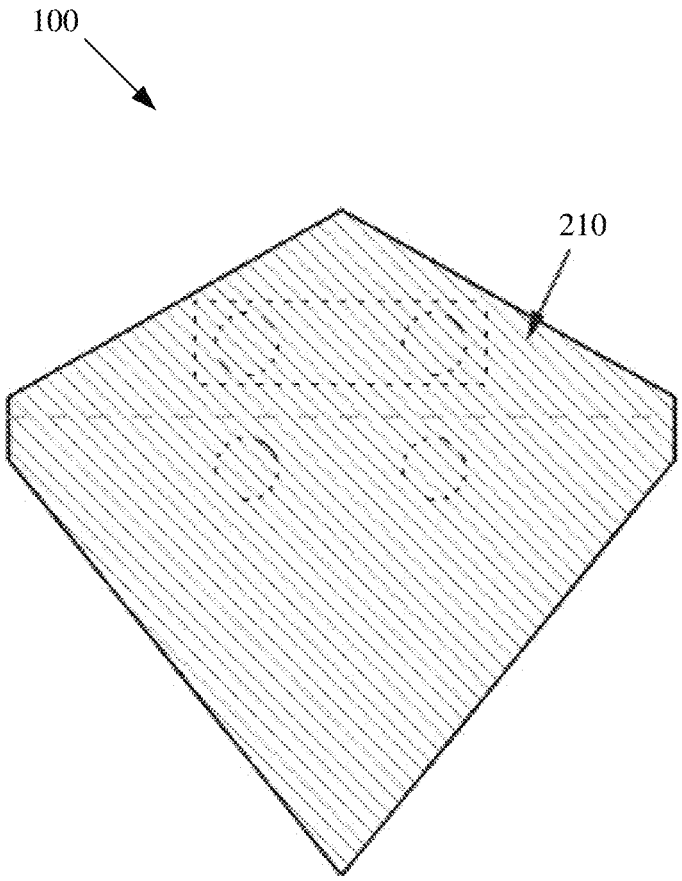
FIG. 2 illustrates an example PSquare with fabric having a first design or pattern in accordance with some embodiments.
Figure 3:
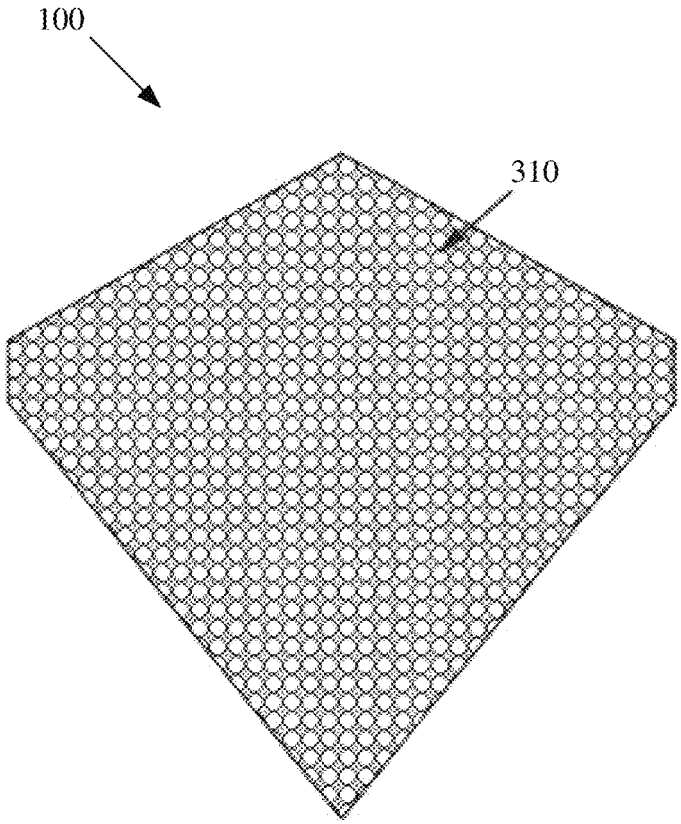
FIG. 3 illustrates an example PSquare with fabric having a different second design or pattern in accordance with some embodiments.
Figure 4:
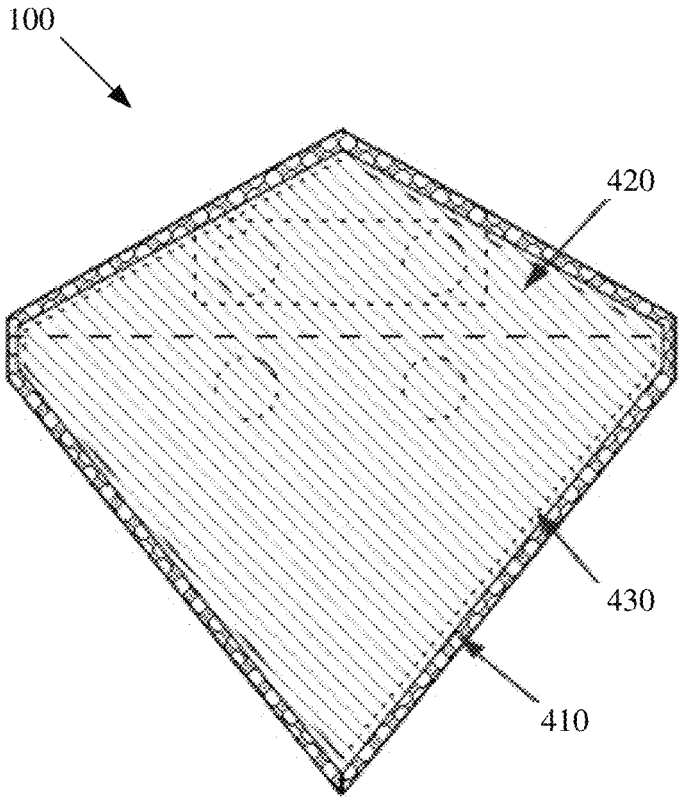
FIG. 4 provides a rear view of an example PSquare with a first outer fabric having an exterior facing and visible first pattern, and a second inner fabric having an interior facing and hidden second pattern.

For instance, FIG. 2 illustrates PSquare 100 with fabric 150 having a first design or pattern 210 in accordance with some embodiments, and FIG. 3 illustrates PSquare 100 with fabric 150 having a different second design or pattern 310 in accordance with some embodiments. FIG. 4 provides a rear view of PSquare 100, and an example of forming PSquare 100 with a first outer fabric 410 having an exterior facing and visible first pattern, and a second inner fabric 420 having an interior facing and hidden second pattern. Fabrics 410 and 420 may be stitched, adhered, or otherwise bonded together at seam 430.

Figure 5:
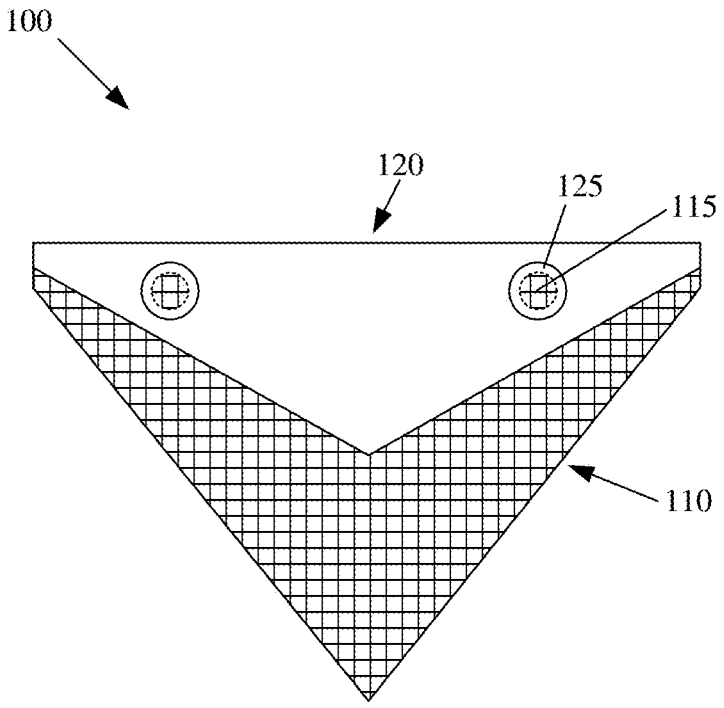
FIG. 5 illustrates an example of folding the upper half at the bend plane in order to align the PSquare magnets.
Figure 6:
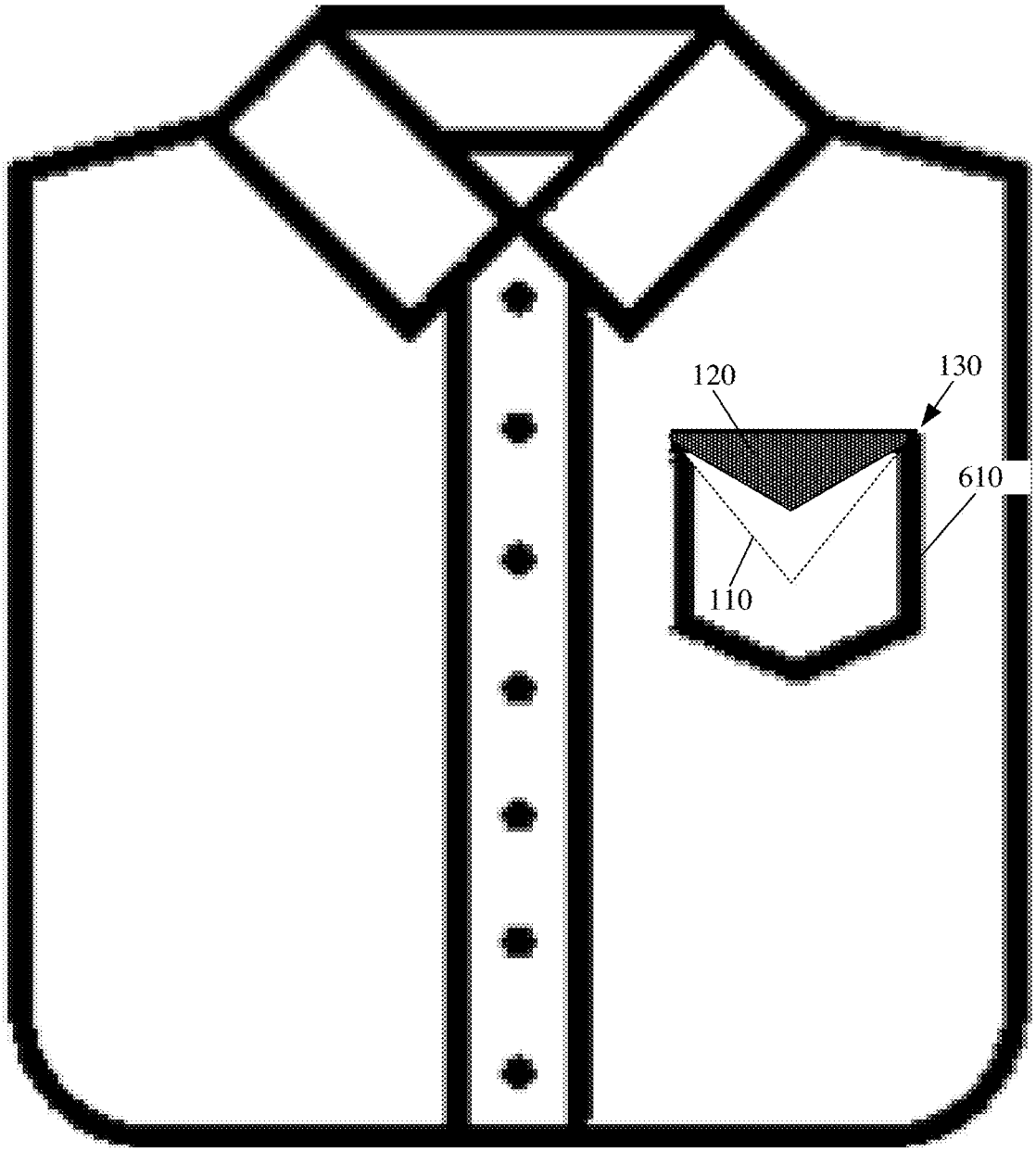
FIG. 6 illustrates the PSquare being attached to a pocket in accordance with some embodiments.
Figure 7:
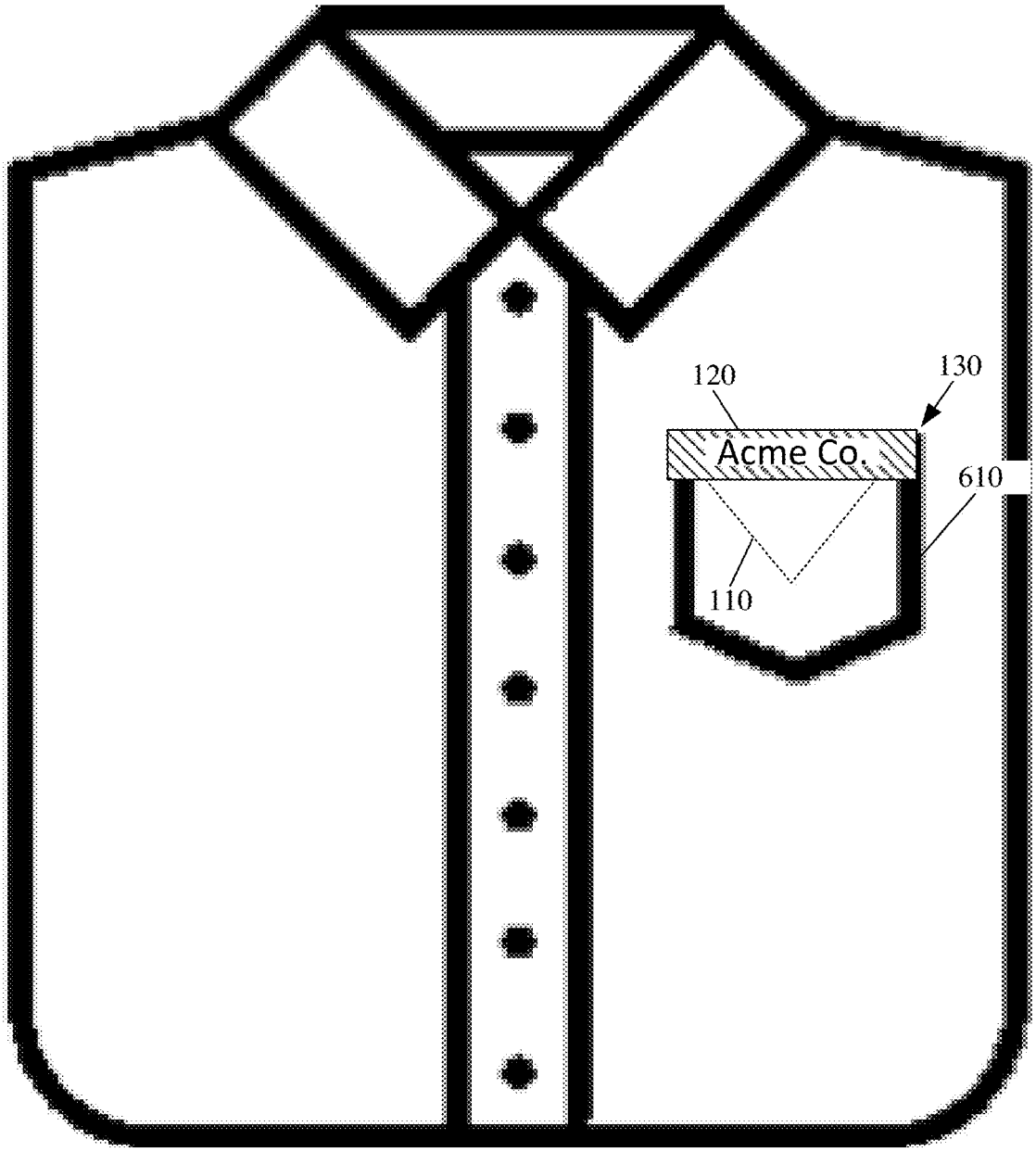
FIG. 7 illustrates the PSquare with an alternative rectangular shape being attached to a pocket in accordance with some embodiments.

FIG. 5 illustrates an example of folding upper half 120 at bend plane 130 in order to align magnets 115 and 125, and create a magnetic force that couples upper half 120 to lower half 110. FIG. 6 illustrates PSquare 100 being attached to pocket 610 in accordance with some embodiments. In particular, usage of PSquare 100 may include inserting lower half 110 of PSquare 100 into an opening of pocket 610. Lower half 110 may be inserted up to bend plane 130. Upper half 120 of PSquare 100 may then be bent over the pocket until magnets 115 and 125 create a magnetic force that holds PSquare 100 in position over the pocket 610 lip. In particular, lower half 110 is positioned about the inside of pocket 610 with upper half 120 folding over the outside of pocket 610, and with the magnetic force fixing the position of PSquare 100 despite the pocket 610 fabric or material being positioned in between lower half 110 and upper half 120. FIG. 7 illustrates PSquare 100 with an alternative rectangular shape being attached to pocket 610 in accordance with some embodiments.

Magnets 115 may also be used to couple supplemental elements to PSquare 100, and further customize PSquare 100 according to user preferences. For instance, some embodiments provide supplemental elements that can connect magnetically to the back of PSquare 100, and that extend upwards to provide additional visual flair.

Figure 8:
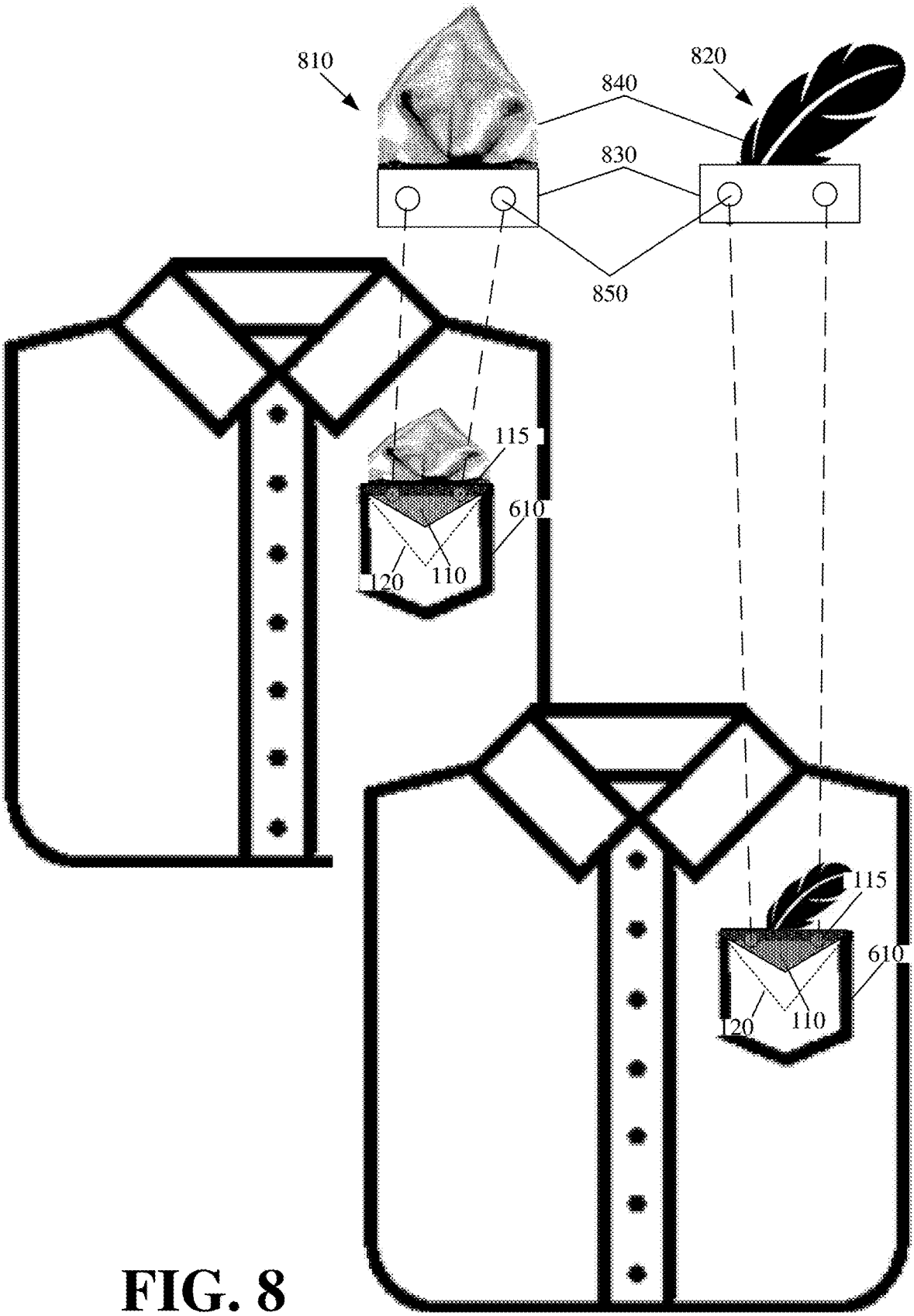
FIG. 8 provides examples of two interchangeable supplement elements and that can be used to customize the PSquare in accordance with some embodiments.

FIG. 8 provides examples of two interchangeable supplement elements 810 and 820 that can be used to customize PSquare 100 in accordance with some embodiments. Each supplemental element 810 and 820 may include a bottom connecting section 830, and an upper visual enhancing section 840.

Bottom connecting section 830 may include a rigid material with one or more magnets 850 that are positioned with the same spacing and positioning as magnets 115 of lower half 120. Magnets 850 are of an opposite polarity as magnets 115. Accordingly, when bottom connecting section 830 is brought behind lower half 120, a magnetic force may be generated by magnets 850 and magnets 115, connecting bottom connection section 830 to lower half 120 of PSquare 100.

Upper visual enhancing section 840 of each supplemental element 810 and 820 may have a different shape, color, texture, material, and/or other visual property. For instance, supplemental element 810 may have upper visual enhancing section 840 formed from a shaped handkerchief that is attached to bottom connection section 830 of supplemental element 810. Supplemental element 820 may have upper visual enhancing section 840 with a decorative feather. In some embodiments, upper visual enhancing section 840 of different elements 810 or 820 may include different artistic or decorative elements. In some embodiments, upper visual enhancing section 840 of different elements 810 and 820 may include different logos, names, etc. to indicate support and/or association with different groups. By coupling different supplemental elements 810 and 820 to PSquare 100, users can further customize PSquare 100 according to their personal interests.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

I claim:

1. A single piece pocket square for accessorizing an outside of a pocket or clothing edge, the single piece pocket square comprising:

an inner rigid material extending between an upper section and a lower section of the single piece pocket square, the upper section comprising one of a triangular shape or a rectangular shape of a first size that extends upward from a base having a particular width, and the lower section comprising a triangular shape of a different second size that extends downward from the base of the particular width and that narrows to a single point;

a bend plane located across the base of the upper section and the base of the lower section at which a backside of the upper section folds vertically down onto a backside and top part of the lower section with a bottom part of the lower section remaining uncovered as a result of the upper section having the first size that is smaller than the second size of the lower section;

at least one first magnet attached directly above the bend plane on the backside of the base of the upper section of the inner rigid material;

at least one second magnet attached directly below the bend plane on the backside of the base of the lower section of the inner rigid material; and a fabric covering an entire frontside of the single piece pocket square that is opposite to the backside, wherein the fabric is adhered to a frontside of each of the upper section and the lower section, wherein the lower section retains a position of the single piece pocket square from inside the pocket or the clothing edge, and wherein the upper section secures to the lower section via a magnetic force that is created in response to the upper section folding down at the bend plane over the outside of the pocket or the clothing edge, and aligning the at least one first magnet with the at least one second magnet on an inside of the pocket or the clothing edge.

2. The single piece pocket square of claim 1, wherein the at least one first magnet and the at least one second magnet are vertically aligned.

3. The single piece pocket square of claim 1, wherein the fabric comprises a first pattern that covers the frontside of the single piece pocket square, and a different second pattern that covers a backside of the single piece pocket square.

4. The single piece pocket square of claim 1 further comprising a supplemental element comprising (i) a base with at least one third magnet, and (ii) an upward extending physical structure.

5. The single piece pocket square of claim 4, wherein a magnetic force is created between the at least one third magnet and the at least one second magnet coupling and retaining a position of the supplemental element behind the lower section with the upward extending physical structure of the supplemental element extending up from over the single piece pocket square.

6. The single piece pocket square of claim 5, wherein the upward extending physical structure comprises a loose fabric organized in a particular arrangement and is attached to the base at one end.

7. The single piece pocket square of claim 1, wherein the inner rigid material comprises one or more of cardboard or plastic.

8. The single piece pocket square of claim 1 further comprising adhesive affixing the at least one first magnet to the upper section of the inner rigid material, and affixing the at least one second magnet to the lower section of the inner rigid material.

9. The single piece pocket square of claim 1, wherein the at least one first magnet comprises two magnets on a common vertical plane of the upper section, and wherein the at least one second magnet comprises two magnets on a different common vertical plane of the lower section that is equidistant from the bend plane as the common vertical plane of the two magnets of the at least one first magnet.

10. The single piece pocket square of claim 1, wherein a width of the single piece pocket square is about equal to a width a shirt or jacket breast pocket.

* * * * *